US007396009B2

(12) United States Patent
Elliott et al.

(10) Patent No.: US 7,396,009 B2
(45) Date of Patent: Jul. 8, 2008

(54) METHOD AND DEVICE FOR CORRECTING PICK TIMING IN AN IMAGE FORMING DEVICE

(75) Inventors: Delbert Lester Elliott, Georgetown, KY (US); Benjamin C. DeVore, Lexington, KY (US); Christopher E. Rhoads, Georgetown, KY (US)

(73) Assignee: Lexmark International Inc., Lexington, KY (US)

( * ) Notice: Subject to any disclaimer, the term of this patent is extended or adjusted under 35 U.S.C. 154(b) by 234 days.

(21) Appl. No.: 11/230,098

(22) Filed: Sep. 19, 2005

(65) Prior Publication Data

US 2007/0063415 A1 Mar. 22, 2007

(51) Int. Cl.
*B65H 5/00* (2006.01)

(52) U.S. Cl. ..... 271/10.03; 271/4.03

(58) Field of Classification Search ..... 271/4.03, 271/10.03

See application file for complete search history.

(56) References Cited

U.S. PATENT DOCUMENTS 5,018,718 A 5/1991 Matsuno et al.
5,119,146 A 6/1992 Nobumori et al.
5,197,726 A 3/1993 Nogami
5,211,387 A 5/1993 Lloyd et al.
5,423,527 A 6/1995 Tranquilla
5,461,468 A 10/1995 Dempsey et al.
5,495,326 A 2/1996 Mikida
5,575,466 A 11/1996 Tranquilla
5,597,154 A * 1/1997 Yamashita ..... 271/10.05
5,692,741 A 12/1997 Nakamura et al.
5,692,742 A 12/1997 Tranquilla
5,826,157 A 10/1998 Wierszewski
5,848,784 A 12/1998 Tranquilla
6,014,542 A 1/2000 Hozumi et al.
6,076,821 A * 6/2000 Embry et al. ..... 271/10.01
6,105,954 A * 8/2000 Magee et al. ..... 271/10.03
6,227,534 B1 5/2001 Schoedinger et al.
6,330,424 B1 12/2001 Chapman et al.
6,370,354 B1 4/2002 Chapman et al.
6,381,441 B1 4/2002 Byeon et al.
6,508,465 B1 1/2003 Endo
6,519,443 B1 2/2003 Coriale et al.
6,533,264 B1 * 3/2003 Tranquilla ..... 271/10.02
6,567,620 B2 5/2003 Brown, Jr. et al.
6,568,285 B1 * 5/2003 Moore et al. ..... 73/862.55
6,570,354 B1 5/2003 Dobbertin et al.
6,572,100 B1 * 6/2003 Tranquilla ..... 271/195
6,651,980 B2 11/2003 Isemura et al.
6,655,677 B2 12/2003 Marshall et al.

(Continued)

*Primary Examiner*—Patrick Mackey
*Assistant Examiner*—Howard Sanders
(74) *Attorney, Agent, or Firm*—Coats & Bennerr, PLLC

(57) ABSTRACT

Methods and devices for moving a media sheet along a media path from an input area to a toner transfer area. One method comprises initially determining that the media sheet is to be moved from the input area. After making the determination, the media path is detected to ensure it is capable of moving the media sheet. If the media path is available, the media sheet is picked and moved along the path. If the media path is not available, the media sheet remains in the input area until the path is available. When required to wait for the path, an amount of delay is determined. Once the path is available, the delayed media sheet is picked from the input area and then accelerated to compensate for the delay.

19 Claims, 6 Drawing Sheets

U.S. PATENT DOCUMENTS 6,712,357 B1 * 3/2004 Tranquilla ..... 271/273
6,729,613 B2 * 5/2004 Marra et al. ..... 271/10.02
6,814,353 B1 * 11/2004 Kakuta et al. ..... 271/186
6,869,241 B2 3/2005 Ouchi et al.
7,068,969 B2 * 6/2006 Ueda ..... 399/388
7,176,955 B2 * 2/2007 Tanabe ..... 347/215
2001/0022422 A1 * 9/2001 Tamura ..... 271/10.03
2003/0085505 A1 * 5/2003 Inoue et al. ..... 271/10.01
2005/0046105 A1 * 3/2005 Richardson et al. ..... 271/272
2005/0179191 A1 * 8/2005 Vernetti et al. ..... 271/4.1
2005/0189700 A1 * 9/2005 Uchida ..... 271/147
2006/0214359 A1 * 9/2006 Clark ..... 271/186

* cited by examiner

METHOD AND DEVICE FOR CORRECTING PICK TIMING IN AN IMAGE FORMING DEVICE

BACKGROUND

Media sheets for use in an image forming device are initially stored in an input area. The input area is sized to hold a predetermined number of media sheets. A pick mechanism is positioned adjacent to the input area to pick individual media sheets from the stack and deliver them into a media path. The pick mechanism should accurately deliver the media sheet to the media path in a timely manner.

The media sheet moves along the media path and receives a toner image at a transfer area. In one type of device, the toner image is applied directly to the media sheet. In another type of device, the toner image is initially placed on an intermediate member, and then transferred from the intermediate member to the media sheet.

Movement of the media sheet along the media path is important for good print quality. If the media sheet is delayed while being picked from the input area, the toner image may not be centered on the media sheet. Likewise, the toner image may not be centered if the media sheet is picked early from the input area. In either event, a non-centered toner image results in a print defect that may not be acceptable to the user.

The speed of the media sheet may be corrected as the media sheet moves along the media path. A lagging media sheet may be sped up, and a leading media sheet may be slowed down. However, changing the media sheet speed affects the inter-page gap. This may lead to a lower number of media sheets that can be formed within a given amount of time. A quality image forming device should deliver a high device output with minimal to no print defects.

SUMMARY

The present application is directed to embodiments of moving a media sheet along a media path from an input area to a toner transfer area. One embodiment comprises a method that initially determines that the media sheet is to be moved from the input area. After making the determination, the media path is detected to ensure it is capable of moving the media sheet. If the media path is available, the media sheet is picked and moved along the path. If the media path is not available, the media sheet remains in the input area until the path is available. When required to wait for the path, an amount of delay is determined. Once the path is available, the delayed media sheet is picked from the input area and then accelerated to compensate for the delay.

DETAILED DESCRIPTION

The present application is directed to a method and device for moving media sheets along a media path. The embodiments determine a position of the media sheet along the media path and determine whether the media sheet is ahead or behind of an expected position. The speed of the media sheet can be adjusted accordingly to move the media sheet to the proper alignment. This ensures that the media sheet receives a toner image at the proper timing and prevents image offset that results in a print defect.

Figure 1:
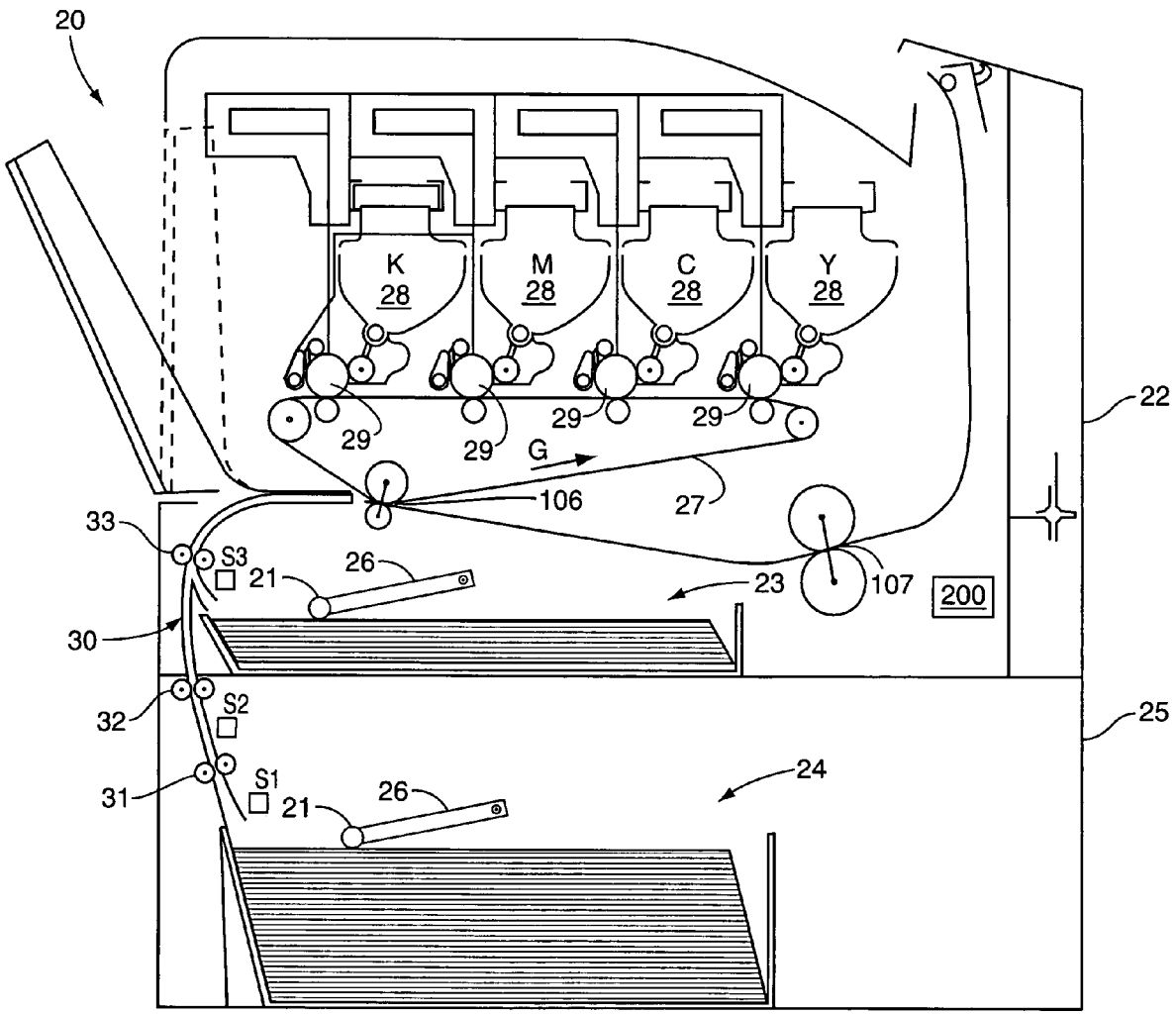
FIG. 1 is a schematic view of an image forming device according to one embodiment of the present invention.

To understand the workings and context of the present application, FIG. 1 illustrates one embodiment of an image forming device 20. Media sheets are introduced into a media path 30 from a first input area 23 or a second input area 24. First input area 23 is positioned within a first body 22, and second input area 24 is positioned within a second body 25. The second input area 24 may have a larger capacity for holding media sheets than the first input area 23. In the event the device 20 needs additional media sheet capacity, the second input area 24 may be attached to the body 22.

A pick mechanism 26 is positioned within each of the input areas 23 and 24 for moving a media sheet into the media path 30. Pick mechanisms 26 may include a pivoting arm with a pick roller 21 at the distal end that rests on a top-most sheet of a stack. Rotation of the pick roller 21 causes the top-most sheet to be moved from the stack and into the media path 30. The media sheet is moved by a series of rollers 31, 32, 33 along the media path 30 to a second transfer point 106 to receive a toner image that is formed by one or more cartridges 28.

The device 20 includes one or more cartridges 28, each with a similar construction but distinguished by the toner color contained therein. In one embodiment, the device 20 includes a black cartridge (K), a magenta cartridge (M), a cyan cartridge (C), and a yellow cartridge (Y). Each cartridge 28 includes a reservoir holding a supply of toner, and a photoconductive (PC) member 29. Each cartridge 28 forms an individual monocolor image on the PC member 29 that is combined in layered fashion on an intermediate transfer mechanism (ITM) member 27. The ITM member 27 is endless and rotates in the direction indicated by arrow G around a series of rollers adjacent to the PC members 29. Toner is deposited from each PC member 29 as needed to create a full color image on the ITM member 27. The ITM member 27 and each PC drum 29 are synchronized so that the toner from each PC drum 29 precisely aligns on the ITM member 27 during a single pass.

As the toner images are being formed on the ITM member 27, the media sheet is moved from the input area 23, 24 along the media path 30. The media path 30 comprises a series of rollers that form media nips 31, 32, 33 spaced a distance apart between the second input area 24 and the second transfer point 106. One or more sensors S1, S2, S3, etc. are placed along the media path 30 to determine the position of the media sheet. A controller 200 oversees the formation of the toner image on the PC member 27 and movement of the media sheet along the media path 30. The speed can be adjusted as necessary for the media sheet to properly intercept the toner image at the second transfer point 106.

Figure 2:
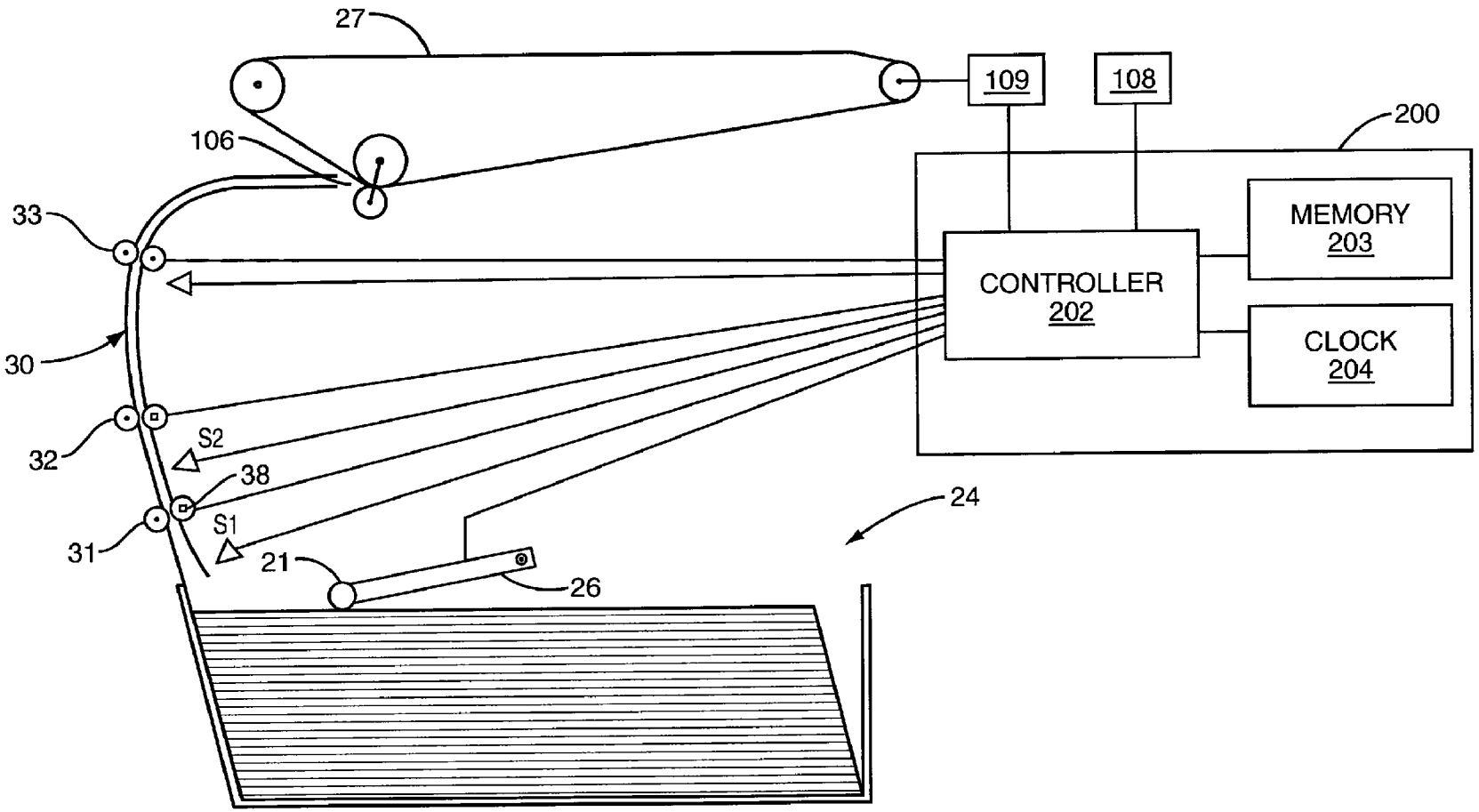
FIG. 2 is a schematic view of a controller and various elements of the image forming device according to one embodiment of the present invention.

Controller 200 oversees the timing of the toner images and the media sheets to ensure the two coincide at the second transfer point 106. In one embodiment as illustrated in FIG. 2, controller 200 includes a microcontroller 202 with associated memory 203, and a clock 204. This may include a microprocessor, random access memory, read only memory, and in input/output interface. Controller 200 monitors when the laser assembly begins to place a latent image on the PC members 29, and at what point in time the first line of the toner image is placed onto the ITM member 27. In one embodiment, controller 200 monitors scan data from the laser assembly and the number of revolutions and rotational position of a drum motor 108 that drive the PC members 29. A single drum motor 108, or multiple motors 108, drives the PC members 29. In one embodiment, the number of revolutions and rotational position of drum motor 108 is ascertained by an encoder.

As the first writing line of the toner image is transferred onto the ITM member 27, controller 200 begins to track incrementally the position of the image on ITM member 27 by monitoring the number of revolutions and rotational position of a motor 109. An encoder may ascertain the number of revolutions and rotational position of the motor 109. From the number of rotations and rotational position of the motor 109, the linear movement of ITM member 27 and the toner image carried thereby can be directly calculated. Since both the location of the image on ITM member 27 and the length of member between each of the PC members 29 and second transfer point 106 is known, the distance remaining for the toner images to travel before reaching the second transfer point 106 can also be calculated.

At some designated time, pick mechanism 26 receives a command from the controller 200 to pick a media sheet. The media sheet enters into the media path 30 and is moved at a process speed through each of the rolls 31, 32, 33. After passing through each of the nips 31, 32, 33, one or more of the rolls separate to prevent skew or drag from being placed on the sheet. This process is illustrated in FIGS. 3*a*, 3*b*, 3*c*, and 3*d*.

Figure 3A:
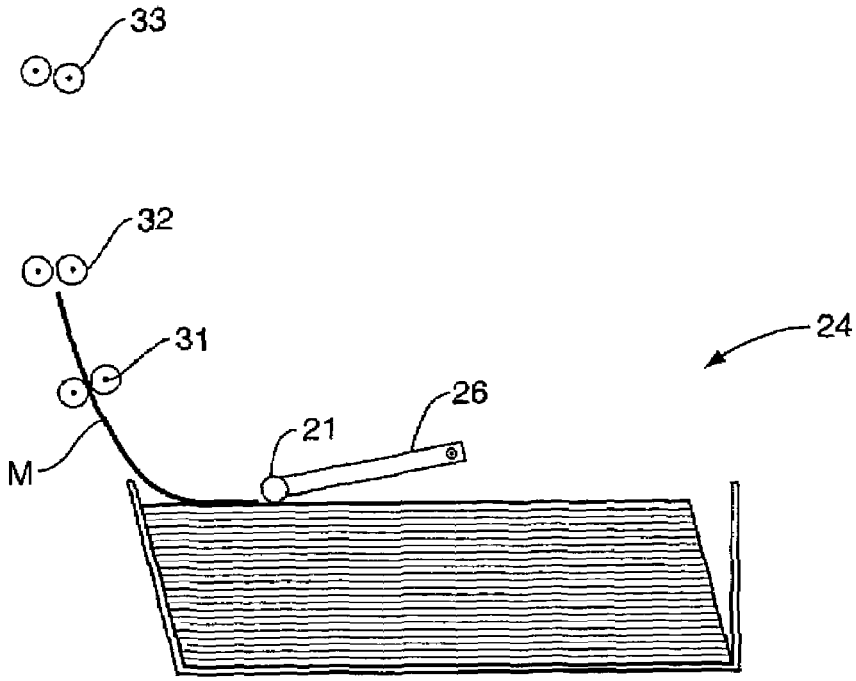
FIGS. 3A-D are schematic views illustrating a media sheet moving along a section of the media path according to one embodiment of the present invention.
Figure 3B:
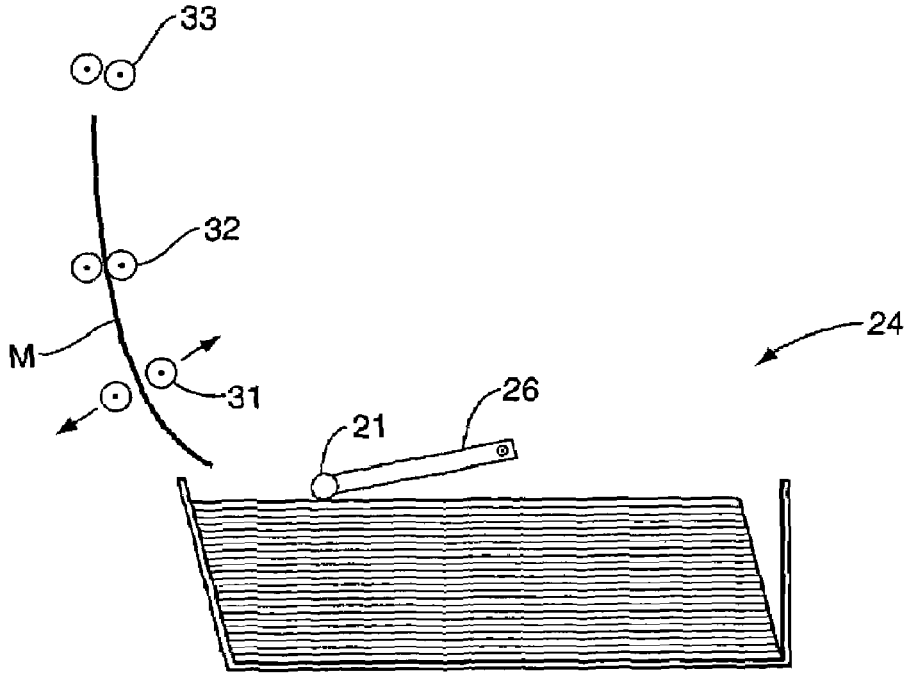
Figure 3C:
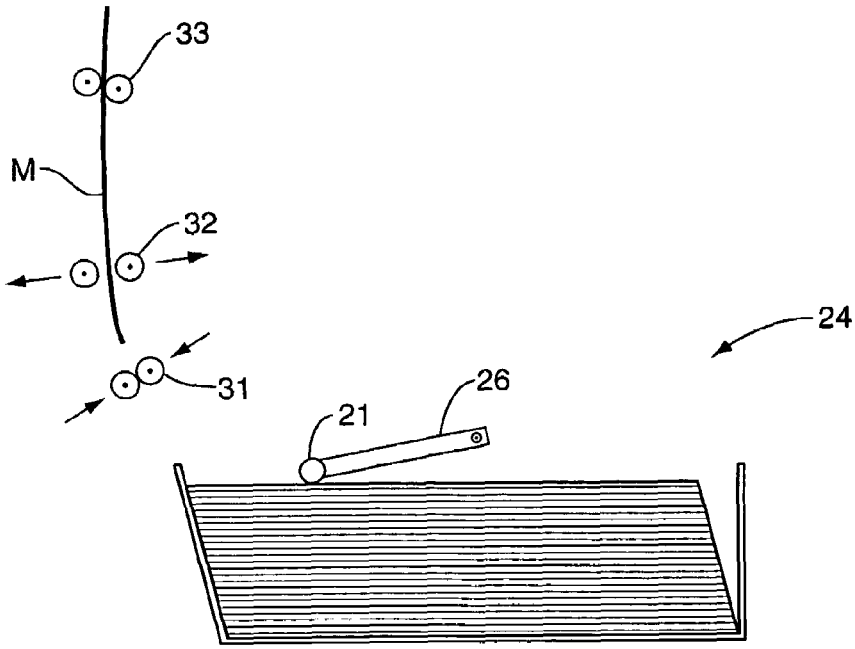
Figure 3D:
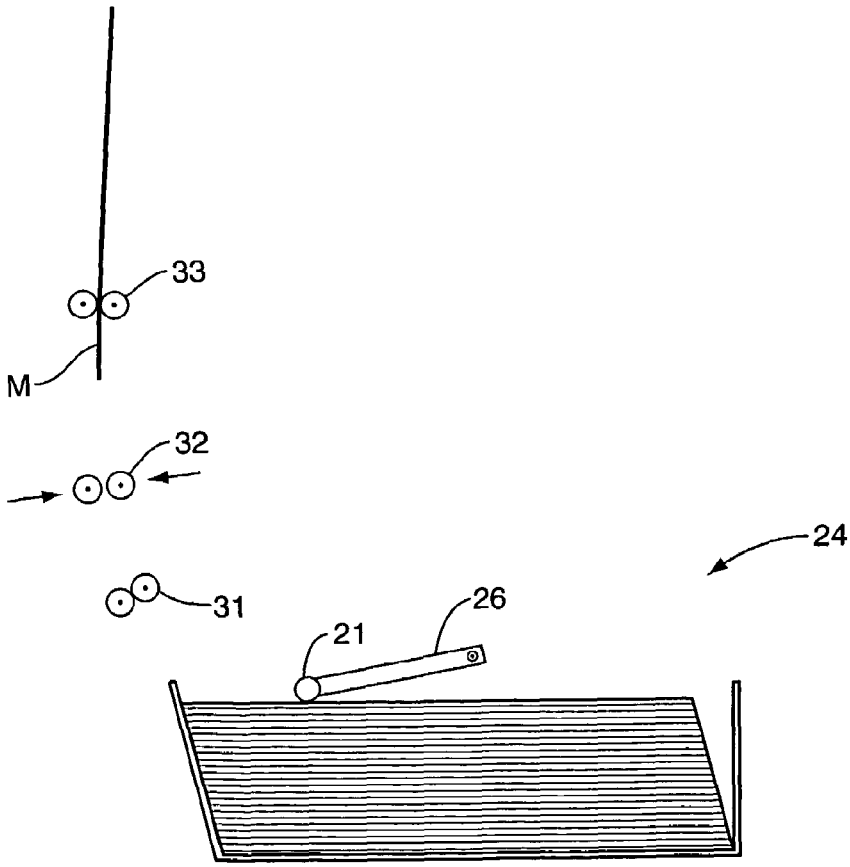

FIG. 3*a* illustrates a media sheet M picked from the second input area 24 and positioned within the first nip 31. As the sheet progresses along the media path as illustrated in FIG. 3*b*, the media sheet M is now within nip 32 with the rolls being in contact with and controlling the speed of the media sheet M. Rolls of nip 31 separate to prevent placing drag or skewing the media sheet M. As illustrated in FIG. 3*c*, media sheet M has progressed along the media path 30 and is controlled by nip 33. The rolls of nip 32 are no longer driving the media sheet M and have separated, while the rolls of nip 31 have moved back to the closed orientation as the trailing edge has moved beyond this point. Finally, as illustrated in FIG. 3*d*, media sheet M is only contacted by nip 33 and rolls of nip 32 have moved back to the closed orientation.

Figure 4:
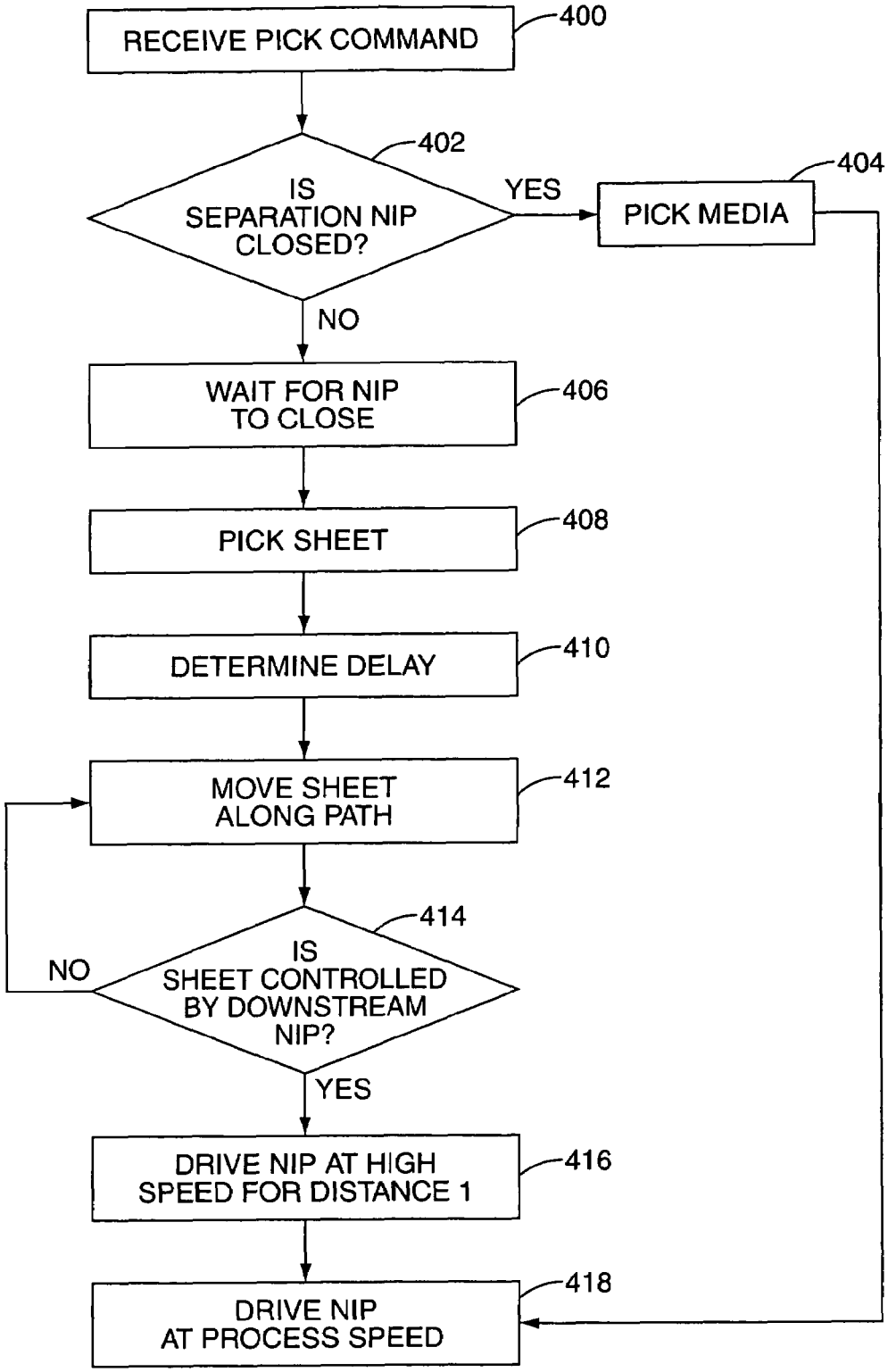
FIG. 4 is a flowchart illustrating the steps of compensating for a delay according to one embodiment of the present invention.

Controller 200 does not perform a pick function from the second input area 24 while rolls of nip 31 are in the open orientation. Instead, controller 200 waits until receiving a signal from sensor 38 that rolls of nip 31 are in a closed orientation. At that time, the media sheet is picked and introduced into the media path 30. Controller 200 tracks the length of the delay between when the pick should have started, and when the pick actually started. Controller 200 will increase of the speed of one or more of the nips 31, 32, 33 to compensate for the delay. FIG. 4 illustrates one method of compensating for the delay.

The process begins with the controller 200 determining that a media sheet is to be picked from the second input area 24 (step 400). Controller 200 determines whether rolls of nip 31 are in a closed orientation (step 402). If the rolls of nip 31 are closed, a media sheet can be picked from the second input area at the scheduled time (step 404). If the rolls of nip 31 are in an open orientation, controller 200 waits for the nip to close (step 406). After the rolls are in the closed orientation, the media sheet is picked from the second input area 24 (step 408). Controller 200 then determines the amount of delay in introducing the media sheet into the media path 30 (step 410). The media sheet is moved by the pick roll 21 until it is within the nip of rolls 31 (step 412).

Controller 200 next determines or verifies that the media sheet is being controlled by rolls of nip 31 (step 414). Controller 200 then accelerates rolls of nip 31 to increase the speed of the media sheet and make up for the delay (step 416). The rolls of nip 31 are operated at the higher speed for a predetermined period of time, and then the speed of the rolls of nip 31 are decreased back to process speed (step 418). The delay caused at the pick has thus been corrected and nips 31, 32, 33 can drive the media sheet at process speed to intercept the toner image at the second transfer point 106.

Figure 5:
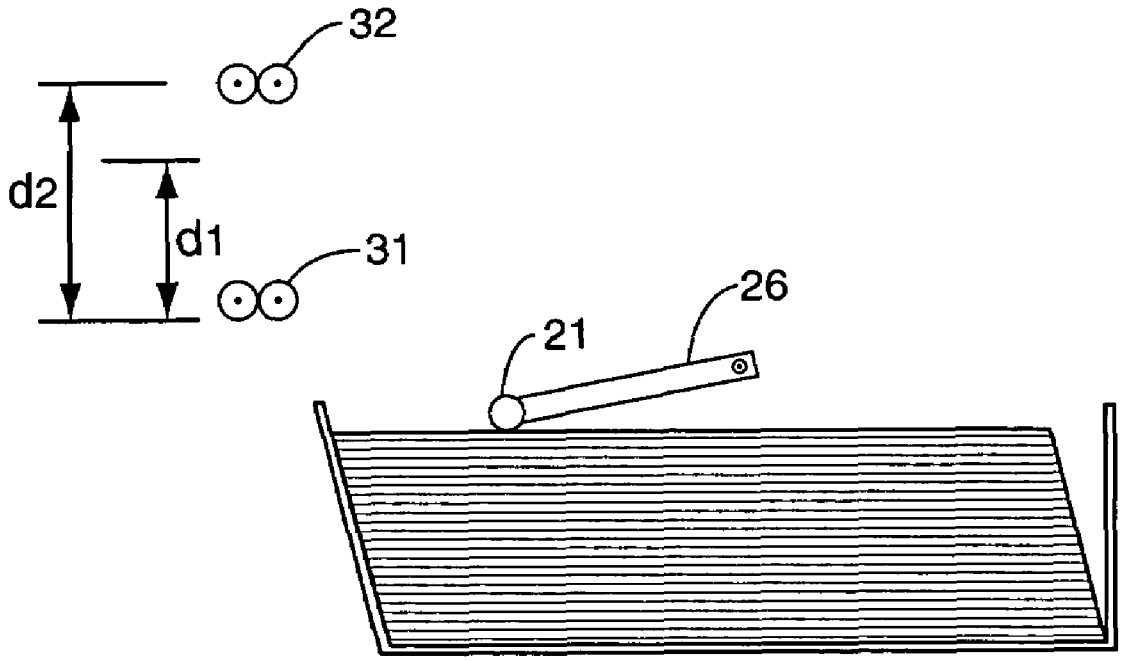
FIG. 5 is a schematic view of the media path according to one embodiment of the present invention.

The controller 200 determines the accelerated speed to compensate for the pick delay. FIG. 5 illustrates a schematic representation of the available distance between nips 31, 32 for increasing the relative position of the media sheet along the media path 30. Rolls 31, 32 are separated along the media path 30 by a distance d2. The required distance to accelerate the media sheet is defined as d1. The distance d1 is defined by the following equation:

$$d1=\text{speed1}\times[(\text{time1}\times\text{speed2})/(\text{speed 1}-\text{speed2})] \quad \text{(Eq. 1)}$$

where d1=required distance to move the media sheet at the accelerated speed;

d2=distance between rolls;

speed1=accelerated speed of media sheet;

speed2=process speed of media sheet; and time1=delay time between pick command and actual pick.

The distance d1 is less than or equal to the available distance d2 between the nips 31, 32. In one embodiment, distance d1 is less than distance d2 by a predetermined amount. This amount provides time to ramp the accelerated speed of the rolls of nip 31 down such that it matches process speed (speed2) by the time the leading edge initially contacts rolls of nip 32. In one specific embodiment, the predetermined amount is about 50 mm.

Speed1 may vary depending upon the application. In one specific embodiment, speed1 is about 400 mm/sec. Speed2 is the speed required to move the media sheet from the pick mechanism 26 to the second transfer point 106 to accurately intercept the media sheet when there is no pick delay. In one specific embodiment, speed2 is about 106 mm/sec.

The delay in the media sheet may be corrected at a variety of locations along the media path. In one embodiment, the correction occurs between the first two nips along the media path downstream from the input area. Using the embodiment of FIG. 1 as an example, the correction occurs between nips 31 and 32. The correction may also occur at other locations along the media path 30. Again using the example of FIG. 1, the correction may occur between rolls 32 and 33 with rolls 32 operating at an accelerated speed to correct for the delay. In another embodiment, rolls 33 operate at an accelerated speed to correct the delay.

The delay correction may also occur at two or more nips. Part of the delay is corrected as the media sheet is accelerated at a first nip, and the remainder is corrected by accelerating a second nip. In these embodiments, the first nip is accelerated to move the media sheet a first distance. The first nip may remain at the accelerated speed at the hand-off to the second nip that is also operating at an accelerated speed. In another embodiment, the first nip is accelerated for a distance and then slowed to process speed for the hand-off to the second downstream nip. The second nip initially operates at process speed and then accelerates to an elevated speed to correct the remaining delay. In yet another embodiment, the accelerated nips are not continuously positioned along the media path 30. Using FIG. 1 as an example, a first correction occurs as the media sheet is moving through nip 31, and the remaining correction occurs as the media sheet moves through nip 33. The nips may operate at the same elevated speed, or different elevated speeds.

In one embodiment, a first nip accelerates the media sheet to compensate for the delay. However, the first nip overcorrects the position of the media sheet that now becomes ahead of schedule. Therefore, a second nip downstream from the first decelerates the media sheet and places the media sheet at the proper position.

Controller 200 may also delay moving the media sheet into the media path 30 for a variety of reasons. In one embodiment, a delay occurs if a second or third downstream nip is in the open orientation. This may occur particularly in high speed image formation where the media sheet is picked from the input area and rapidly moved through the first downstream nip in a short amount of time that does not provide for the next downstream nips to return to the closed orientation. Delays may also be caused by the temperature of the fuser 107 being below a predetermined level, and interpage gap adjustments for actions that occur in the interpage gap.

Controller 200 may pick a media sheet prior to the nip returning to the closed orientation. The controller 200 may determine that the amount of time required for the nip to be at the closed orientation is less than the time necessary for the media sheet to reach the nip. By way of example using the embodiment of FIG. 1, media sheet is picked from second input area 24 while the nip 31 is returning from the open orientation towards the closed orientation. By the time the media sheet reaches the nip 31, it will be closed and able to contact and move the media sheet along the media path 30.

One or more sensors S1 S2, S3, etc. are placed along the paper path 30 to determine the position of the media sheet. In one embodiment, sensors S1, S2, S3, etc. are optical sensors that detect a leading edge or trailing edge of the media sheet when passing the sensor location.

In one embodiment, the position of the image on the ITM member 27 is determined by HSYNCs that occur when the laser assembly makes a complete scan over one of the photoconductive drums. Controller 200 monitors the number of HSYNCs and can calculate the position of the image. In one embodiment, one of the colors, such as black, is used as the HSYNC reference for determining timing aspects of image movement. The HSYNCs occur at a known periodic rate and the ITM belt surface speed is assumed to be constant.

After moving through the rolls 31, 32, 33, the media sheet intercepts the toner image at the second transfer point 106 and the image is transferred to the media sheet. The media sheet with toner image passes through a fuser 107 that adheres the toner image to the sheet. The media sheet is then either outputted from the device 20, or sent through a duplex path (not illustrated) for forming a toner image on a second side.

The present application may be used for a double transfer system such as the embodiment illustrated in FIG. 1. Examples of a double transfer system include Model Nos. C750 and C752 each available from Lexmark International, Inc. of Lexington, Ky. The application may also be used for a directed transfer system where the toner image is directly transferred from the PC members 29 to the media sheet.

FIG. 2 illustrates a single controller 200 that oversees operation of the first and second input areas 23, 24. In another embodiment, two or more controllers oversee operation with a first controller overseeing operation of the first input area 23, and a second controller overseeing operation of the second input area 24.

The present methods and devices may be carried out in other specific ways than those herein set forth without departing from the scope and essential characteristics of the invention. In one embodiment, sensors S1, S2, S3, etc. are optical sensors that detect a leading edge or trailing edge of the media sheet when passing the sensor location. The present application may be used for moving media sheets from the second input area 24 or the first input area 23. The present embodiments are, therefore, to be considered in all respects as illustrative and not restrictive, and all changes coming within the meaning and equivalency range of the appended claims are intended to be embraced therein.

What is claimed is:

1. A method of moving a media sheet along a media path in an image forming device, the method comprising the steps of:

determining that the media sheet is to be moved from an input area;

detecting that a downstream nip is in an open orientation and the media path is not able to receive the media sheet;

determining when the downstream nip has moved from the open orientation to a closed orientation and the media path is able to receive the media sheet;

moving the media sheet from the input area into the media path;

determining a delay time due to the downstream nip moving from the open orientation to the closed orientation between when the media sheet is to be moved from the input area and when the media sheet is moved into the media path; and accelerating the media sheet at an elevated speed along the media path for a predetermined period of time; and moving the media sheet along the media path at process speed and receiving a toner image.

2. The method of claim 1, wherein the step of detecting that the media path is not able to receive the media sheet comprises determining that a nip is in an open orientation.

3. The method of claim 2, wherein the step of determining when the media path is able to receive the media sheet comprises determining that the nip is in a closed orientation.

4. The method of claim 1, wherein the step of accelerating the media sheet at the elevated speed along the media path for the predetermined period of time comprises driving a first nip and the second nip at the elevated speed.

5. The method of claim 4, further comprising driving the first nip at a first speed and driving the second nip at a second speed that is different than the first speed.

6. The method of claim 1, further comprising slowing the media sheet from the elevated speed back towards a process speed and moving the media sheet from a first body to a second body.

7. The method of claim 1, further comprising picking the media sheet from the input area after formation of a toner image on an intermediate member.

8. A method of moving a media sheet along a media path in an image forming device, the method comprising the steps of:

determining that the media sheet is to be moved from an input area;

detecting that a downstream nip is in an open orientation;

determining that the downstream nip has moved from the open orientation to a closed orientation;

moving the media sheet from the input area into the media path;

determining a delay in moving the media sheet into the media path resulting from waiting for the downstream nip to move to the closed orientation; and accelerating the media sheet at an elevated speed along the media path for a predetermined period of time and reducing an interpage gap caused by the delay.

9. The method of claim 8, wherein the step of accelerating the media sheet at the elevated speed along the media path for the predetermined period of time and removing the delay comprises increasing the downstream nip speed to move the media sheet at the elevated speed.

10. The method of claim 9, further comprising reducing the downstream nip speed from the elevated speed to a process speed prior to hand-off of the media sheet to a second downstream nip.

11. The method of claim 8, further comprising moving the downstream nip to the open orientation after the media sheet has moved into contact with a second downstream nip.

12. The method of claim 8, wherein the step of detecting that the downstream nip is in the open orientation comprises detecting a first nip downstream from the input area.

13. The method of claim 8, wherein the step of accelerating the rolls along the media path at the elevated speed for the predetermined period of time and removing the delay comprises accelerating the downstream nip and a second nip.

14. The method of claim 13, further comprising accelerating the downstream nip to a first speed and accelerating the second nip to a different second speed.

15. A device to control the movement of a media sheet along a media path in an image forming device, the device comprising:

an input area;

a media path comprising a first nip and a second nip;

a pick mechanism to move the media sheet from the input area into the media path; and a controller that controls operation of the first and second nips and the pick mechanism, the controller operative to determine a delay time from when a pick command is received and the first nip is in an open orientation until the first nip moves from the open orientation to a closed orientation, once the first nip is at the closed orientation the controller moving a media sheet from the input area to the media path and increasing a speed of one of the first and second nips to an elevated speed to remove a lag in the media sheet caused by the delay while waiting for the first nip to move to the closed orientation.

16. The device of claim 15, wherein one or both of the controller and a second controller increases the speed of both the first and second nips to the elevated speed to remove the lag.

17. The device of claim 15, wherein the first nip is positioned upstream of the second nip along the media path, the controller increasing the speed of the first nip to the elevated speed for a predetermined period of time and then reducing to a process speed prior to handing off the media sheet to the second nip.

18. The device of claim 15, wherein the controller moves the media sheet from the input area while the first nip is in the open orientation.

19. The device of claim 15, wherein the controller increases the speed of the first nip to the elevated speed and increases the speed of the second nip to a second elevated speed that is different than the elevated speed.

* * * * *